US007568469B2

(12) United States Patent
Tokuo et al.

(10) Patent No.: US 7,568,469 B2
(45) Date of Patent: Aug. 4, 2009

(54) CONTROL DEVICE FOR A HIGH-PRESSURE FUEL SUPPLY SYSTEM USING VARIABLE DISPLACEMENT FUEL PUMP WITH REDUCED POWER CONSUMPTION

(75) Inventors: Kenichiro Tokuo, Hitachinaka (JP); Hiroyuki Yamada, Hitachinaka (JP); Satoshi Usui, Hitachinaka (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/582,396

(22) Filed: Oct. 18, 2006

(65) Prior Publication Data

US 2007/0089711 A1 Apr. 26, 2007

(30) Foreign Application Priority Data

Oct. 19, 2005 (JP) ..... 2005-304671

(51) Int. Cl.
*F02M 37/04* (2006.01)

(52) U.S. Cl. ..... 123/497; 123/446

(58) Field of Classification Search ..... 123/446, 123/457, 506, 449, 497
See application file for complete search history.

(56) References Cited

U.S. PATENT DOCUMENTS 4,449,507 A * 5/1984 Mayer ..... 123/467
4,454,713 A * 6/1984 Meyer et al. ..... 60/39.281
5,197,438 A * 3/1993 Kumano et al. ..... 123/506
6,116,870 A * 9/2000 Kraemer ..... 417/490
6,311,674 B1 * 11/2001 Igashira et al. ..... 123/458
7,114,491 B2 * 10/2006 Hamada et al. ..... 123/516

FOREIGN PATENT DOCUMENTS

JP 2000-8997 1/2000
JP 2005-69668 3/2005

* cited by examiner

*Primary Examiner*—Stephen K Cronin
*Assistant Examiner*—J. Page Hufty
(74) *Attorney, Agent, or Firm*—Crowell & Morin gLLP

(57) ABSTRACT

A high pressure fuel supply system includes: a high pressure fuel pump having a normally closed electromagnetic valve; and a controller for calculating a valve open signal and a valve close signal for the electromagnetic valve in accordance with a state amount of an engine, and supplying a drive current to the electromagnetic valve, wherein the controller applies and the valve close signal having a time duration shorter than a valve close response time during a valve open period of the electromagnetic valve, the valve close response time being a time taken to close the electromagnetic valve after the valve close signal is applied. The controller applies alternately and periodically the valve close signal and valve open signal during the valve open period of the electromagnetic valve.

12 Claims, 8 Drawing Sheets

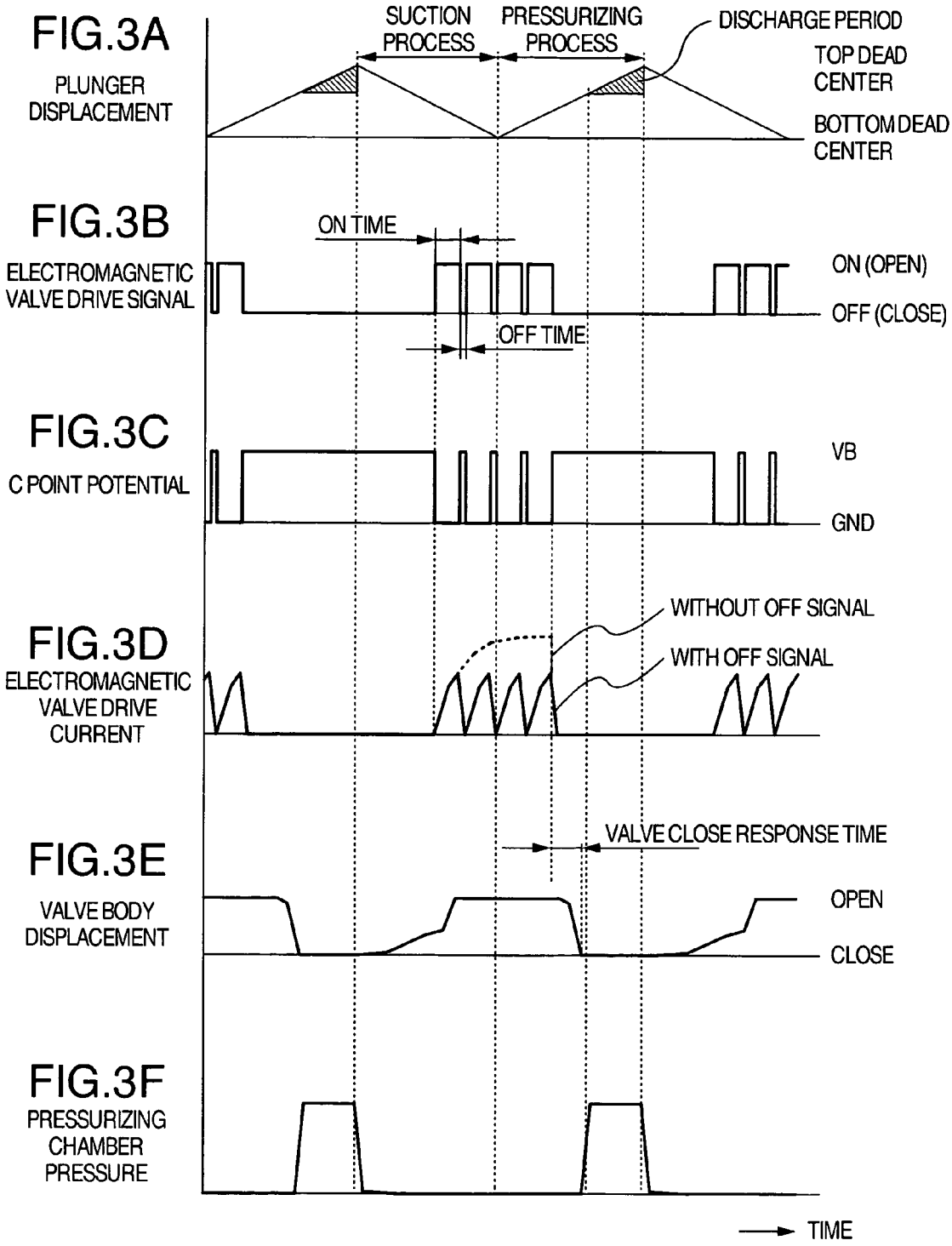
FIG.3A
PLUNGER DISPLACEMENT
SUCTION PROCESS
PRESSURIZING PROCESS
DISCHARGE PERIOD
TOP DEAD CENTER
BOTTOM DEAD CENTER
FIG.3B
ELECTROMAGNETIC VALVE DRIVE SIGNAL
ON TIME
OFF TIME
ON (OPEN)
OFF (CLOSE)
FIG.3C
C POINT POTENTIAL
VB
GND
FIG.3D
ELECTROMAGNETIC VALVE DRIVE CURRENT
WITHOUT OFF SIGNAL
WITH OFF SIGNAL
FIG.3E
VALVE BODY DISPLACEMENT
VALVE CLOSE RESPONSE TIME
OPEN
CLOSE
FIG.3F
PRESSURIZING CHAMBER PRESSURE
TIME

PLUNGER DISPLACEMENT
TOP DEAD CENTER
BOTTOM DEAD CENTER

ELECTROMAGNETIC VALVE DRIVE SIGNAL
ON TIME
OFF TIME
ON (OPEN)
OFF (CLOSE)

D POINT POTENTIAL
VB
GND

ELECTROMAGNETIC VALVE DRIVE CURRENT
WITHOUT OFF SIGNAL
WITH OFF SIGNAL

VALVE BODY DISPLACEMENT
VALVE CLOSE RESPONSE TIME
OPEN
CLOSE

PRESSURIZING CHAMBER PRESSURE
TIME

PLUNGER DISPLACEMENT
TOP DEAD CENTER
BOTTOM DEAD CENTER

DRIVE SIGNAL 1
ON TIME
OFF TIME
ON (OPEN)
OFF (CLOSE)

DRIVE SIGNAL 2
ON (OPEN)
OFF (CLOSE)

C POINT POTENTIAL
VB
GND

ELECTROMAGNETIC VALVE DRIVE CURRENT
WITHOUT OFF SIGNAL
WITH OFF SIGNAL

VALVE BODY DISPLACEMENT
VALVE CLOSE RESPONSE TIME
OPEN
CLOSE

PRESSURIZING CHAMBER PRESSURE
TIME

CONTROL DEVICE FOR A HIGH-PRESSURE FUEL SUPPLY SYSTEM USING VARIABLE DISPLACEMENT FUEL PUMP WITH REDUCED POWER CONSUMPTION

BACKGROUND OF THE INVENTION

The present invention relates to a high pressure fuel supply system using a fuel pump of an internal combustion engine, and more particularly to apparatus for reducing caloric power dissipation of a variable displacement high pressure fuel pump.

Direct injection engines (spark ignition gasoline direct injection internal combustion engines) for vehicles have been developed recently in order to clean exhaust gases and reduce fuel consumption for environmental maintenance. In a gasoline direct injection internal combustion engine, fuel is injected via a fuel injection valve directly into a combustion chamber of a cylinder. The droplet diameter of fuel injected via the fuel injection valve is reduced to promote burning of injected fuel, reduce particular substances in exhaust gas, reduce fuel consumption, and so on.

In order to reduce the droplet size of fuel injected via a fuel injection valve, it is necessary to highly pressurize fuel. Various technologies have been proposed for a high pressure fuel pump for supplying high pressure fuel via a fuel injection valve in a pressurized state (e.g., Patent Documents JP-A-2000-8997 and JP-A-2005-69668).

According to Japanese patent document JP-A-2000-8997, a high pressure fuel flow to supply a fuel injection amount via the fuel injection valve is controlled to reduce the high pressure fuel pump drive power. Electromagnetic valves of two types (a normally opened type and a normally closed type), are used as the flow control mechanism. In both cases, the volume of fuel to be pressurized by the high pressure fuel pump is controlled by adjusting the timing when the suction valve closes during a discharge process.

Japanese patent document JP-A-2005-69668 discloses a high pressure fuel pump equipped with a normally closed type electromagnetic valve as a suction valve. Collision sounds of a valve body during a valve open operation are reduced by supplying a valve open signal at the timing intermediate of a suction process.

In a high fuel pump equipped with a normally closed type electromagnetic valve such as disclosed in Japanese patent documents JP-A-2002-8997 and JP-A-2005-69668, the electromagnetic valve is continuously supplied with electric power, for an extended period in some cases. For example, when fuel is not consumed, such as during engine braking, the high pressure fuel pump does not discharge fuel continuously. In this state, since the electromagnetic valve is maintained in a valve open state, the electromagnetic valve is continuously supplied with an electric power. Therefore, problems arise such as overheating of the electromagnetic valve, an increase in a consumption energy of the whole system, and a large load on the drive circuit. Although there is a method of controlling drive current on a drive circuit side to suppress power consumption by the electromagnetic valve, a current control circuit is generally expensive, so that this current control method cannot be used in an inexpensive system. The present invention has been made in consideration of the above-described issues.

SUMMARY OF THE INVENTION

One object of the present invention therefore, is to provide a high pressure fuel supply system solves the above-described problems of the related arts.

Another object of the present invention is to provide a high pressure fuel supply system capable of reducing a caloric power dissipation of an electromagnetic valve by using an inexpensive structure, and reducing energy consumption and load on a whole system.

These and other objects and advantages are achieved by the high pressure fuel supply system according to the invention, which includes a high pressure fuel pump having a pressurizing chamber for fuel, a pressurizing member for sending pressurized fuel in the pressurizing chamber toward a discharge passage, and a normally closed electromagnetic valve disposed in a suction passage.

Fuel in the pressurizing chamber is compressed by an opening/closing operation of the electromagnetic valve and reciprocal operation of the pressurizing member. A controller calculates a valve opening and closing signals for the electromagnetic valve in accordance with an operating state amount of an engine, and supplies a drive current to the electromagnetic valve.

According to the invention, the controller applies a valve closing signal which has a time duration shorter than a valve close response time, during a valve open state of the electromagnetic valve. (The valve close response time is the time taken to close the electromagnetic valve after the valve close signal is applied.) The controller may apply the valve close signal and valve open signal alternately and periodically during the valve open period of the electromagnetic valve.

In the high pressure fuel supply system, the controller may detect the engine speed of the engine or a drive voltage of the electromagnetic valve, and change the ratio between a valve open signal time duration and a valve close signal time duration during the valve open period of the electromagnetic valve, in accordance with the detected engine speed or drive voltage.

According to the present invention, the controller of the fuel supply system applies a valve open signal and a valve close signal alternately and periodically during the valve open period of the electromagnetic valve, to reduce both electromagnetic valve drive current and caloric power consumption. It is also possible to reduce power consumption of the engine as a whole.

Other objects, features and advantages of the invention will become apparent from the following description of the embodiments of the invention taken in conjunction with the accompanying drawings.

BRIEF DESCRIPTION OF THE DRAWINGS

FIGS. 3A to 3F are timing charts illustrating the operation of the pump and pump controller in the high pressure fuel supply system of the embodiment;

DESCRIPTION OF THE EMBODIMENT

Figure 1:
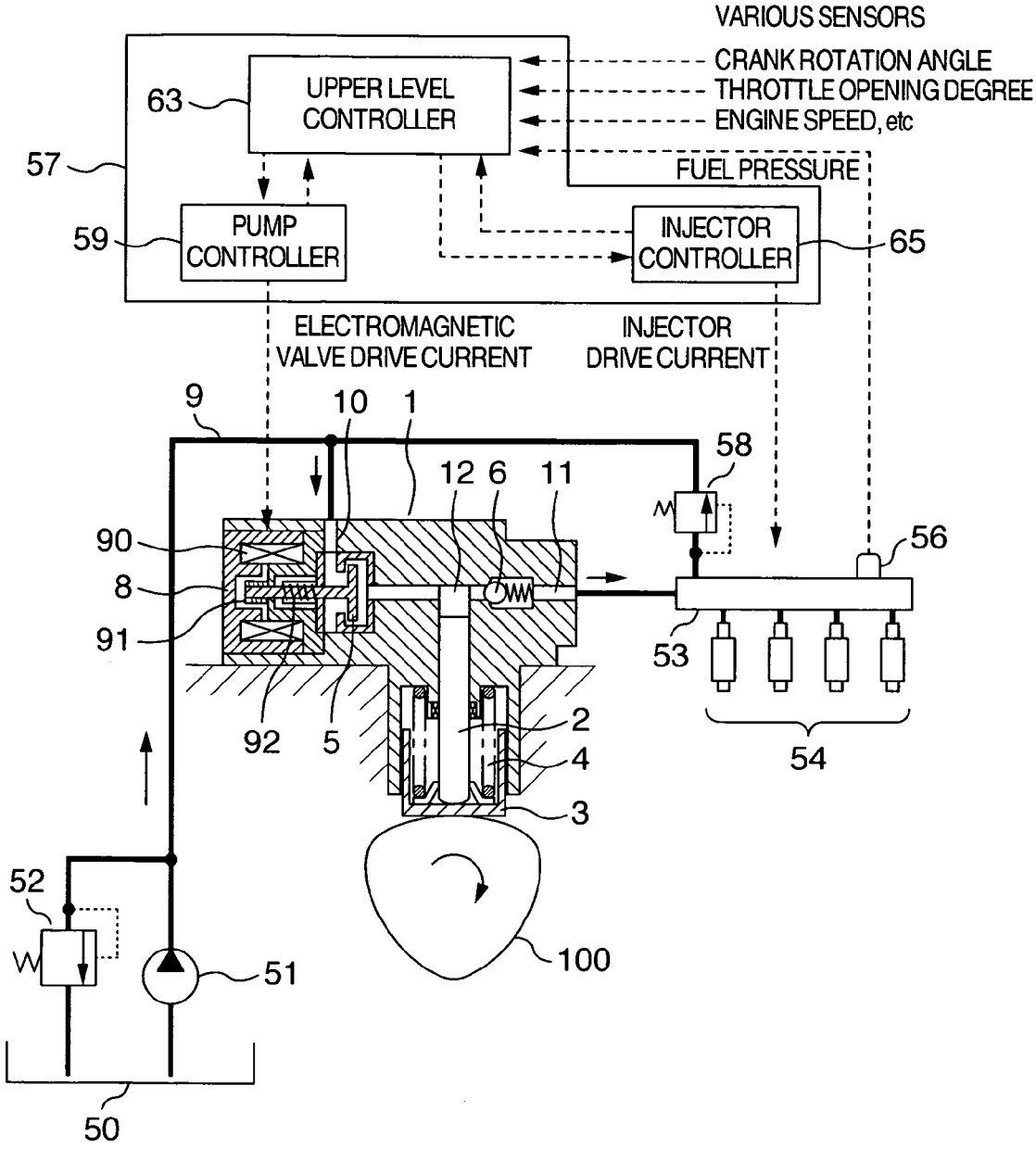
FIG. 1 is a diagram showing the whole configuration of a high pressure fuel supply system for an internal combustion engine according to an embodiment of the invention.
Figure 2:
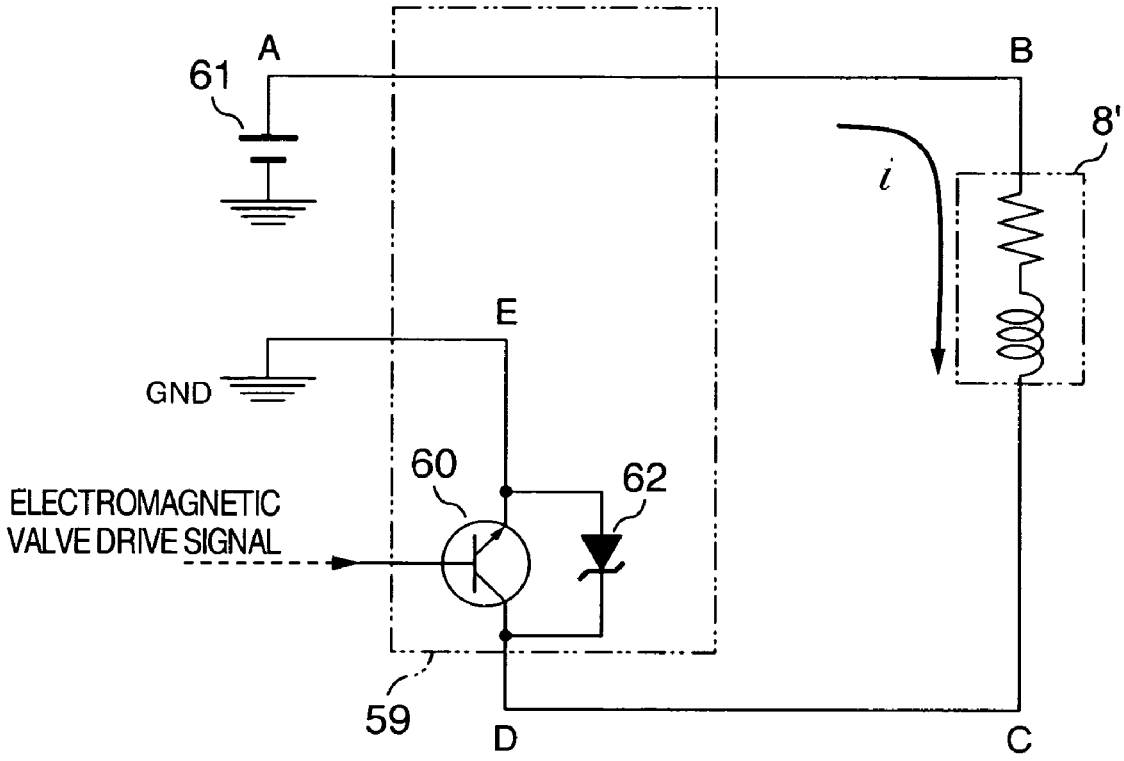
FIG. 2 is a diagram showing a circuit structure of an electromagnetic valve of a pump and a pump controller in the high pressure fuel supply system of the embodiment.
Figure 4:
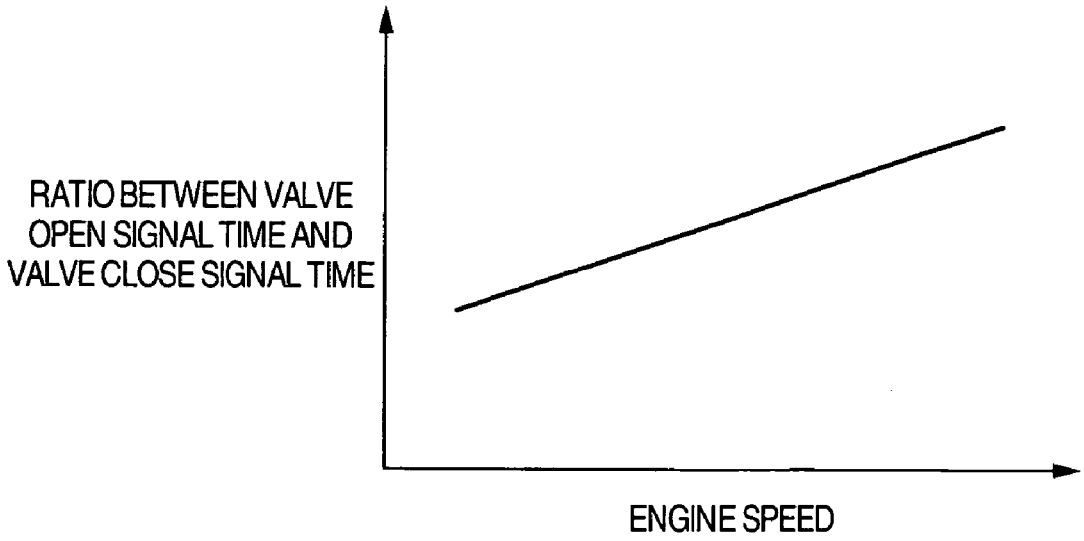
FIG. 4 is a diagram showing the relationship between engine speed and a ratio between valve open and close times in the high pressure fuel supply system of the embodiment.
Figure 5:
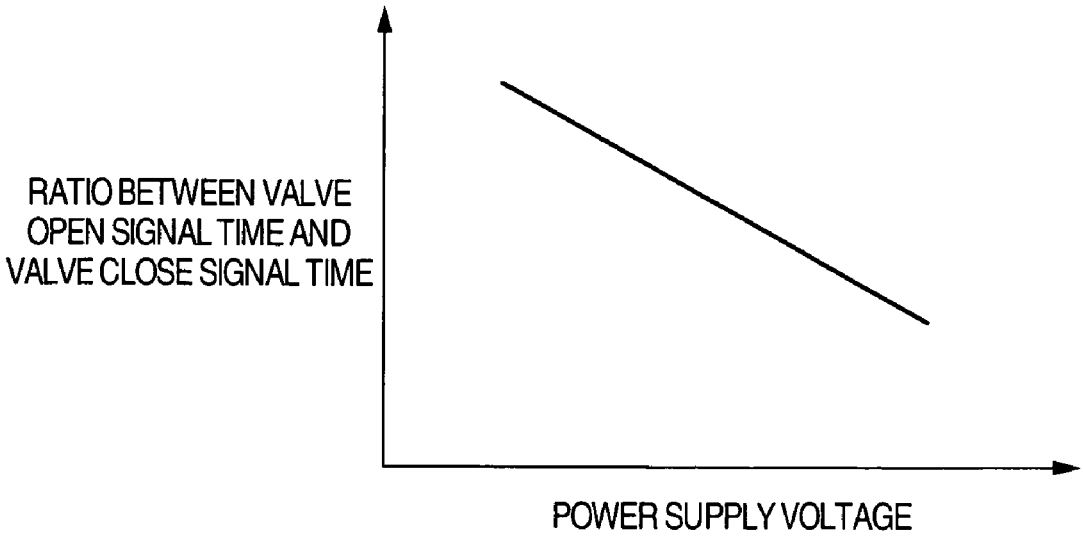
FIG. 5 is a diagram showing the relationship between power supply voltage and the ratio between a valve open and a valve close time in the high pressure fuel supply system of the embodiment.

With reference to FIGS. 1 to 9G, the following is a detailed description of high pressure fuel supply system of an internal combustion engine according to an embodiment of the present invention. FIG. 1 is a diagram showing the whole configuration of a high pressure fuel supply system for an internal combustion engine according to the embodiment of the invention. FIG. 2 is a diagram showing a circuit structure of an electromagnetic valve of a pump and a pump controller in the high pressure fuel supply system of the embodiment. FIGS. 3A to 3F are timing charts illustrating the operation of the pump and pump controller in the high pressure fuel supply system of the embodiment. FIG. 4 is a diagram showing the relationship between engine speed and the ratio between valve open and close times in the high pressure fuel supply system of the illustrated embodiment. FIG. 5 is a diagram showing the relationship between a power supply voltage and a ratio between a valve open time and a valve close time in the high pressure fuel supply system of the embodiment.

Figure 6:
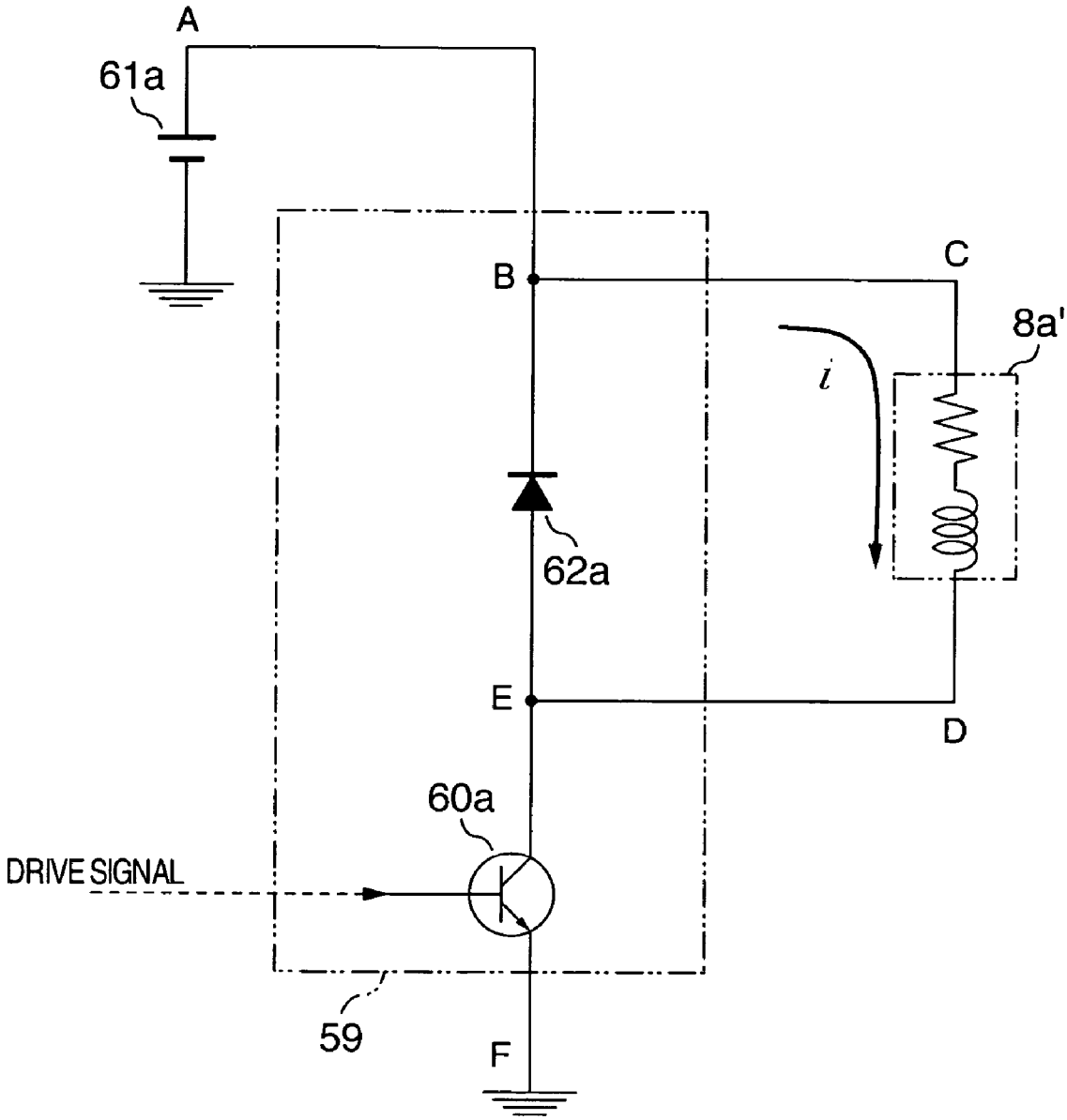
FIG. 6 is a diagram showing another circuit structure of an electromagnetic valve of a pump and a pump controller in the high pressure fuel supply system of the embodiment.

FIG. 6 is a diagram showing another circuit structure of an electromagnetic valve of a pump and a pump controller in the high pressure fuel supply system of the illustrated embodiment. FIGS. 7A to 7F are timing charts that illustrate the operation of the pump and pump controller shown in FIG. 6 in the high pressure fuel supply system of the embodiment. FIG. 8 is a diagram showing another circuit structure of an electromagnetic valve of a pump and a pump controller in the high pressure fuel supply system of the embodiment. FIGS. 9A to 9G are timing charts illustrating the operation of the pump and pump controller shown in FIG. 8 in the high pressure fuel supply system of the embodiment.

As shown in FIGS. 1 to 9G, the high pressure fuel supply system according to the invention includes high pressure fuel pump 1, a plunger 2, a tappet 3, a valve body 5, a discharge valve 6, an electromagnetic valve 8, a suction passage 10, a discharge passage 11, a pressurizing chamber 12, a low pressure pump 15, a common rail 53, injectors 54, a pressure sensor 56, a pump controller 59, an upper level controller 63, a coil 90, an anchor 91, a spring 92, and a cam 100.

First, with reference to FIG. 1, the configuration of a fuel supply system using a variable displacement fuel pump according to the embodiment of the present invention will be described. Formed in the pump main body 1 are the fuel suction passage 10, discharge passage 11 and pressurizing chamber 12. The plunger 2 (a pressurizing member) is slidably mounted in the pressurizing chamber 12. The discharge valve 6 is disposed in the discharge passage 11 so as not to make high pressure fuel on the downstream side flow reversely toward the pressurizing chamber. The electromagnetic valve 8 is disposed in the suction passage 10 in order to control fuel suction. The electromagnetic valve 8 is a normally closed type electromagnetic valve which closes while power is not supplied, and opens while power is supplied.

Fuel is guided from a tank 50 to a fuel guide port of the pump main body 1 by a low pressure pump 51, and pressure of the fuel is controlled to a constant value by a pressure regulator 52. Thereafter, the fuel is pressurized in the pump main body 1 and fed from a fuel discharge port to the common rail 53 in a pressurized state. The injectors 54, a pressure sensor 56 and a relief valve 58 are mounted on the common rail 53. The relief valve 58 opens when fuel pressure in the common rail 53 exceeds a predetermined value to prevent breakage of a high pressure piping system. The number of injectors 54 which are mounted is the same as the number of cylinders of the engine; they jet out fuel in accordance with drive currents supplied from an injector controller 65. The pressure sensor 56 sends acquired pressure data to a controller 57.

In accordance with value of engine state variables (crank rotation angle, throttle opening degree, engine speed, fuel pressure and the like) supplied from various sensors, the controller 57 calculates a proper jet fuel amount, fuel pressure and the like to control the pump 1 and injectors 54. In controller 57, the upper level controller 63 may be provided separately from the controllers 59 and 65 for directly controlling the pump and injectors, or it may be one collective unit. (In this embodiment, the pump controller 59 is provided separately from the upper level controller 63 and controls the pump 1).

The plunger 2 is moved reciprocally by the cam 100, which in turn is rotated by an engine cam shaft and the like, thereby changing the volume in the pressurizing chamber 12. As the plunger 2 moves down and the volume of the pressurizing chamber 12 expands, the electromagnetic valve 8 opens so that fuel flows into the pressurizing chamber 12 from the fuel suction passage 10. (The process while the plunger 2 moves down is hereinafter called a suction process.) As the plunger 2 moves up and the electromagnetic valve 8 closes, fuel in the pressurizing chamber 12 is pressurized and supplied to the common rail 53 via the discharge valve 6 in a pressurized state. (The process while the plunger 2 moves up is hereinafter called a discharge process.)

If the electromagnetic valve 8 closes during the discharge process, fuel sucked in the pressurizing chamber 12 during the suction process is pressurized and discharged to the common rail 53 side. If the electromagnetic valve 8 opens during the discharge process, fuel is pushed back to the suction passage 10 side and the fuel in the pressurizing chamber 12 will not be discharged to the common rail 53 side. In this manner, discharge of fuel in the pump 1 is controlled by opening and closing of the electromagnetic valve 8. Opening and closing of the electromagnetic valve 8 is controlled by the pump controller 59.

The electromagnetic valve 8 has as its constituent components the valve body 5, the spring 92 for energizing the valve body 5 toward the valve open direction, the coil 90 and the anchor 91. As current flows through the coil 90, an electromagnetic force is generated in the anchor 91, which is attracted to the right (as viewed in FIG. 1) so that the valve body 5 integrally formed with the anchor 91 opens. When no current is flowing through the coil 90, the spring 92 biases the valve body 5 toward the valve close direction, so that the valve body 5 closes. The electromagnetic valve 8 is structured such that it closes while no drive current flows, and is called a normally closed electromagnetic valve.

During the suction process, pressure in the pressurizing chamber 12 is lower than that in the suction passage 10. The resulting pressure difference opens the valve body 5, so that fuel is sucked in the pressurizing chamber 12. In this case, although the spring 92 biases the valve body 5 toward the valve close direction, a valve open force by the pressure difference is set larger than the valve close force so that the valve body 5 opens. In this case, as the drive current flows through the coil 90, a magnetic attraction force enhances motion toward the valve open direction so that the valve body 5 becomes easier to open.

On the other hand, during the discharge process, a pressure in the pressurizing chamber 12 is higher than that in the suction passage 10 so that a pressure difference for opening the valve body 5 will not be generated. In this case, if no drive current flows through the coil 90, the valve body 5 is closed by a spring force energizing the valve body 5 toward the valve close direction and other forces. On the other hand, if the drive current flows through the coil 90, the valve body 5 is drawn toward the valve open direction by a magnetic attraction force.

As the drive current flows through the coil 90 of the electromagnetic valve 8 during the suction process and continues to flow also during the discharge process, the valve body 5 remains closed. During this period, fuel in the chamber 12 will not be pressurized because fuel flows back to the low pressure passage 10. On the other hand, if supply of the drive current is interrupted during the discharge process at some timing, the valve body 5 closes and the fuel in the chamber 12 is pressurized and discharged toward the discharge passage 11 side. If the timing when the drive current is stopped is fast, the volume of fuel to be pressurized becomes large, whereas if the timing is slow, the volume of fuel to be pressurized becomes small. The controller 57 controls the timing when the valve body 5 closes, to thereby control a discharge amount of the pump 1.

FIG. 2 is an example of a drive circuit of the pump controller 59. Reference numeral 8' represents the electromagnetic valve 8 in FIG. 1 (represented schematically by an electric resistor and an inductance). The drive circuit includes a power source 61, an FET 60 for controlling current on/off operation and a Zener diode 62 for protecting FET 60 from surge voltage. (The Zener diode 62 may be a discrete component as shown in FIG. 2, or it may be assembled in FET 60.) The constituent components of the pump controller 59 are shown in an area surrounded by a two-dot chain line.

When a drive signal is applied from the upper level controller 63 or pump controller 59 to FET 60, current flows from the power source 61 to the ground via a circuit of A-B-C-D-E. When the drive signal is not applied, current in the circuit A-B-C-D-E is turned off. Thus, with the drive signal ON, drive current flows through the electromagnetic valve 8', while drive current will not flow through the electromagnetic valve 8', when the drive signal is OFF.

FIGS. 3A to 3F illustrate an example of the operation of driving the high pressure fuel pump by a control method, in the high pressure fuel supply system of the embodiment. In particular, FIGS. 3A to 3F are timing charts illustrating drive signals and operations of the fuel supply system of the embodiment. The "plunger displacement" shown in FIG. 3A shows the operation of the plunger 2 in FIG. 1. A rise indicates a pressurizing process, and a fall indicates the suction process. The example shown in FIGS. 3A to 3F indicates a period during which the plunger 2 moves reciprocally twice. The "electromagnetic valve drive signal" in FIG. 3B is applied to FET 60 from the pump controller 59 or upper level controller 63.

As described above, in an ON state of the drive signal, drive current flows through the electromagnetic valve 8, and in an OFF state, the drive current flowing through the electromagnetic valve 8 is turned off. In the ON state of the drive signal, an electromagnetic force of the electromagnetic valve 8 draws the valve body 5 toward the valve open direction, so that the ON state of the drive signal constitutes a valve open signal for the electromagnetic valve 8. In the OFF state of the drive signal, there is no electromagnetic force for energizing the electromagnetic valve 8 toward the valve open direction; however, the force of the spring 92 opens the valve, so that an OFF state of the drive signal forms a valve close signal for the electromagnetic valve 8.

The "C point potential" shown in FIG. 3C indicates a potential at point C in the drive circuit shown in FIG. 2. When the drive signal is OFF, the potential is the same as a power source voltage (VB), and when the drive signal is ON, the potential is the same as a ground potential (GND). The "electromagnetic valve drive current" shown in FIG. 3D indicates current flowing through the electromagnetic valve 8. As the electromagnetic valve drive signal shown in FIG. 3B turns ON, current flows, and when it turns OFF, the current is turned OFF. Since the electromagnetic valve 8 has an inductance, a rise of current lags from the drive signal. The "valve body displacement" shown in FIG. 3E shows displacement of the valve body 5. An "open" position indicates that the valve body 5 moves to the right and that the suction passage 10 communicates with the pressurizing chamber 12. A "close" position means that the valve body 5 moves to the left, and that the suction passage 10 is shut off from the pressurizing chamber 12.

During the suction process, pressure in the pressurizing chamber 12 falls below that in the suction passage 10 so that this pressure difference makes the valve body 5 naturally start moving toward the valve open direction. In this case, if a drive current flows through the electromagnetic valve 8, the magnetic attraction force is generated toward the valve open direction and a valve open operation of the valve body 5 is further accelerated. On the other hand, during the discharge process the valve body 5 maintains its open state only by the magnetic attraction force. If the state that the drive current does not flow continues for a certain period, the valve body 5 resumes the close position. The time taken for the valve body 5 to close after the drive signal is turned OFF is hereinafter called the "valve close response time". (There is a response delay of the valve close response time until the valve body 5 actually closes from an off time point of the electromagnetic valve drive signal.)

As the valve body 5 closes, pressure in the pressurizing chamber 12 rises and fuel is discharged. As shown in FIG. 3F, pressure in the pressurizing chamber starts rising during the pressurizing process at the timing when the valve body 5 closes, and fuel continues to be discharged until the pressurizing process terminates. The period during which fuel is discharged is indicated as a hatched portion shown in FIG. 3A. The longer this period is, the larger fuel discharge amount becomes.

When it is necessary for the pump 1 to discharge more fuel, such as when the output of the internal combustion engine is high, the electromagnetic valve drive signal is turned OFF fast to close the valve body 5 from the start of the pressurizing process in order to prolong the discharge period. When it is necessary for the pump 1 to discharge less fuel, such as when the output of the internal combustion engine is low, the electromagnetic valve drive signal is turned OFF slowly to close the valve body 5 from the last half of the pressurizing process in order to shorten the discharge period. Since there is a predetermined lag time until the valve body 5 closes, the timing when the electromagnetic valve drive signal is turned OFF is determined by the timing when the valve body 5 is desired to be closed, advanced by the valve open delay time.

As shown in FIG. 3B, the electromagnetic valve drive signal is turned ON/OFF a plurality of times during one valve open period (valve open period of the valve body 5 as shown in FIG. 3E). If an OFF signal is applied while the valve body 5 opens, the valve body 5 tends to close. However, if the OFF period is shorter than the valve close response time, the next ON signal is supplied before the valve body opens, so that the open state of the valve body 5 is maintained. On the other hand, if the OFF signal continues to be applied for a period longer than the valve close response time, the valve body 5 closes and the pump 1 starts discharging fuel. In this manner, by applying the OFF signal (valve close signal) for a period shorter than the valve close signal during the valve open period, it becomes possible to reduce an amount of current flowing through the electromagnetic valve 8 and reduce caloric power consumption.

FIG. 3D shows a current waveform indicated by a solid line when the OFF signal exists during the valve open period, and a current waveform indicated by a dotted line when the OFF signal does not exist. If the OFF signal does not exist during the valve open period (continuously ON), the drive current reaches a saturated level, whereas if the OFF signal exists during the valve open period, the current value decreased to a great extent than when the current flows continuously. Further, since the current value is lowered each time the OFF signal is applied, the cumulative value of caloric powers can be reduced. The control method described above can be realized because the OFF signal has a period such that the valve body 5 will not close.

FIG. 3E shows an example in which displacement of the valve body 5 during the valve open period maintains the valve open state. (The embodiment is not limited thereto, however.) The valve body 5 may move toward the valve close direction to some extent and then resume the open state. Pressure in the pressurizing chamber 12 will not rise because, even if the valve body 5 moves toward the valve close direction to some extent, fuel in the pressurizing chamber 12 escapes into the fuel suction passage 10 via a space near the valve body. In other words, it is sufficient if the valve body 5 opens to the extent that fuel in the pressurizing chamber 12 can escape into the fuel suction passage 10. (It is sufficient, even if a perfect open state is not obtained.)

In this embodiment, the electromagnetic valve opens with an electromagnetic valve drive signal ON and it closes with a valve drive signal OFF. If the command of the electromagnetic valve drive signal is reversed (ON=valve close, OFF=valve open), it is sufficient to provide an ON signal having a time duration such that the valve will not close during the valve open period. In both arrangements, the embodiment can be realized by applying a valve close signal having such a time duration such that the electromagnetic valve 8 will not close during the valve open period of the electromagnetic valve 8.

In addition to the control method in which a valve open signal having a time duration shorter than the valve close response time is applied during the electromagnetic valve open period, an approach may be adopted by which a time ratio between the valve open signal and valve close signal during the valve open period is changed with an operation state of the internal combustion engine, to further reduce the caloric power dissipation. Namely, as shown in FIG. 4, the time ratio between the valve open signal and valve close signal during the valve open period is changed with an increase in an engine speed.

The reason for this arrangement is that the valve close response time of the electromagnetic valve changes with the operation state of the engine. This is because the engine speed is proportional to an operation speed of the plunger 2 and an operation speed of the electromagnetic valve 8 is influenced by fuel stirred by the plunger 2. There is therefore a general tendency that the lower the engine speed, the longer the valve close response time is, and the higher the engine speed, the shorter the valve close response time is.

By utilizing the above-described general tendency, the caloric power dissipation of the electromagnetic valve 8 can be reduced further by applying a long valve close signal when the engine speed is low. For example, logic for realizing map control of the ratio between ON and OFF can be assembled in the upper level controller 63 or pump controller 59 for calculating the electromagnetic valve drive signal. Such control is performed by detecting a low engine speed and prolonging the valve close signal (shortening the drive signal ON time for the electromagnetic signal) to reduce further the electromagnetic valve caloric power dissipation.

As another method of further reducing the electromagnetic valve caloric power, as shown in FIG. 5, the time ratio between the valve open signal and valve close signal during the valve open period is changed with a rise of a power supply voltage. If a voltage for driving the electromagnetic valve is high, a rise of the drive current is faster than when the drive voltage is low. Therefore, the valve open state can be maintained by a shorter ON time than when the drive voltage is low. By utilizing this tendency, the caloric power of the electromagnetic valve 8 and a electric consumption power of the system can be reduced by detecting a high power supply voltage and shortening the ON time.

In the control method described above, by which the time ratio between the valve open signal and valve close signal during the valve open period is changed with the operation state of the internal combustion engine to further reduce the caloric power, the engine speed and power supply voltage are used as the example of the operation state. The operation state is not limited thereto, but it may be a flow rate of fuel discharged from the fuel pump, an operation speed of the pressurizing member (plunger 2), and a discharge flow amount of the fuel pump. These examples of the operation state are parameters related to the engine speed and engine load (e.g., discharge flow amount). Of these parameters, the plunger operation speed can be detected as an engine speed, and the discharge flow amount can be detected as an injector injection amount. In accordance with a detected value, control is performed to change the time ratio between the valve open signal and valve close signal.

FIG. 6 and FIGS. 7A to 7F, show another example of drive/control operation of the high pressure pump of the embodiment. FIG. 6 shows another circuit structure, different from that shown in FIG. 2. Reference numeral 8*a*' represents the electromagnetic valve 8 shown in FIG. 1 and represented schematically by an electric resistor and an inductance. The drive circuit includes a power source 61*a*, an FET 60*a* for controlling current on/off and a free wheel diode 62*a*. The free wheel diode 62*a* constitutes a circuit B-C-D-E for circulating current generated by a counter-electromotive force of the electromagnetic valve 8*a*'. The constituent components of the pump controller 59 are shown in an area surrounded by a two-dot chain line.

As a drive signal is applied from the upper level controller 63 or pump controller 59 (FIG. 1) to FET 60*a*, current flows from the power source 61*a* to the ground via a circuit of A-B-C-D-E-F. As the drive signal changes from the ON state to the OFF state, current generated by the counter-electromotive force circulates and attenuated in the circuit B-C-D-E. Similar to the above-described embodiment, as the drive signal is applied to FET 60*a*, a drive current flows through the electromagnetic valve 8*a'*.

Figures 7A, 7B, 7C, 7D, 7E, 7F:
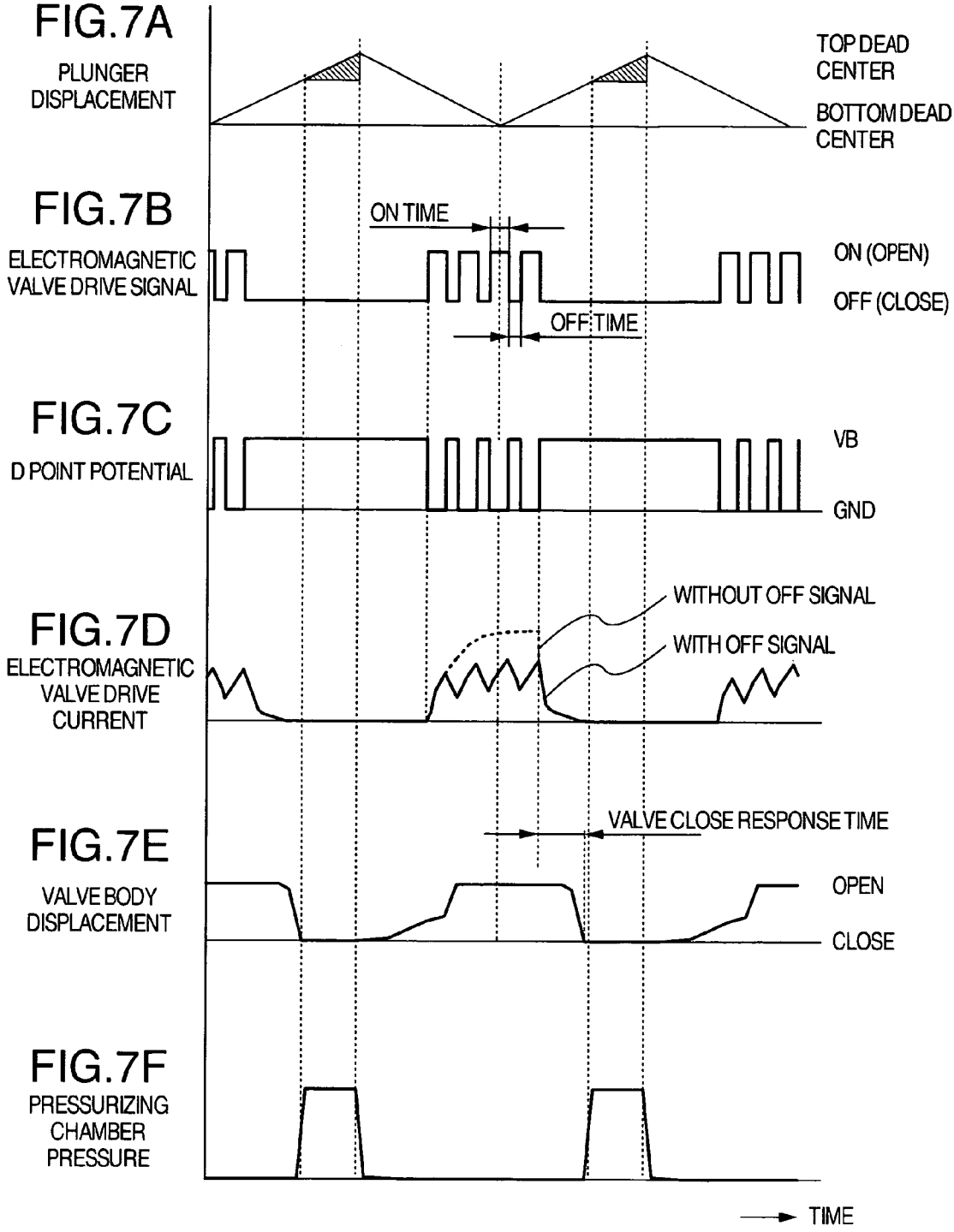
FIGS. 7A to 7F are timing charts illustrating the operation of the pump and pump controller shown in FIG. 6 in the high pressure fuel supply system of the embodiment.
Figure 8:
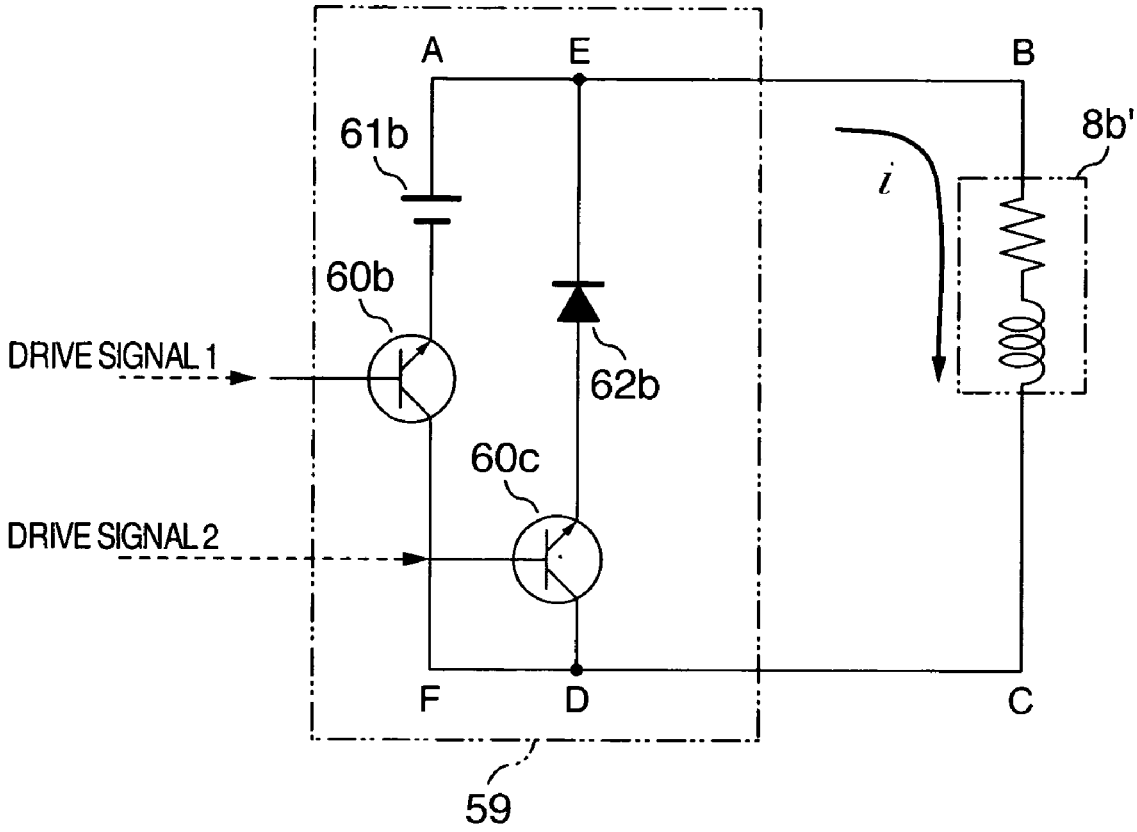
FIG. 8 is a diagram showing another circuit structure of an electromagnetic valve of a pump and a pump controller in the high pressure fuel supply system of the embodiment.

FIGS. 7A to 7F show an example of timing charts illustrating drive signals and valve operations of the circuit structure shown in FIG. 6. Similar to FIGS. 3A to 3F, "plunger displacement" shown in FIG. 7A shows the reciprocal operation of the plunger 2 shown in FIG. 1. The "electromagnetic valve drive signal" shown in FIG. 7B is a drive signal applied to FET 60*a* from the pump controller 59 or upper level controller 63. In an ON state of the drive signal, drive current flows through the electromagnetic valve 8, and in an OFF state, the drive current flowing through the electromagnetic valve 8 attenuates. Similar to the structure shown in FIGS. 1 to 3F, an ON state of the drive signal is a valve open signal for the electromagnetic valve 8, and an OFF state of the drive signal forms a valve close signal for the electromagnetic valve 8.

"D point potential" shown in FIG. 7C indicates a potential at point D in the drive circuit shown in FIG. 6. When the drive signal is OFF, the potential is the same as a power source voltage (VB), and when the drive signal is ON, the potential is the same as a ground potential (GND). An "electromagnetic valve drive current" shown in FIG. 7D indicates a current flowing through the electromagnetic valve 8. As the electromagnetic valve drive signal shown in FIG. 7B turns ON, current flows, and when it turns OFF, the current attenuates. The "valve body displacement" shown in FIG. 7E shows displacement of the valve body 5. A flow amount control method of controlling a discharge flow amount by controlling the timing when the valve body 5 is closed is the same as the method illustrated in FIGS. 1 to 3F.

A difference from the circuit structure shown in FIG. 2 resides in the proposition that it takes time to attenuate the electromagnetic valve drive current, and that it takes a long time ("valve close response time") to close the valve body 5 from when the electromagnetic valve drive signal is turned OFF. Also in this case, the electromagnetic valve drive signals ON and OFF are periodically applied during the open period of the valve body 5 from the suction process to the discharge process. Therefore, the drive current repeats alternately an increase and an attenuation as indicated by the solid line in FIG. 7D to form a waveform like pseudo current control. (The drive current shown in FIG. 7D is formed in a pseudo manner by periodically applying the electromagnetic drive signals ON and OFF during the open period of the valve body 5, without performing direct current control to form the drive current shown in FIG. 7D.) As compared with no OFF signal (indicated by a dotted line), the average current reduces to a greater extent so that the caloric power of the electromagnetic valve 8 and the whole system consumption power can be reduced. This circuit structure has advantages of good durability of the electric circuit because no surge voltage is loaded on FET 60 and Zener diode 62, as in the circuit shown in FIG. 2.

FIG. 8 and FIGS. 9A to 9G, show another drive/control operation of the high pressure pump of the embodiment. FIG. 8 shows another circuit structure, which differs from that shown in FIG. 2. This circuit structure drives the electromagnetic valve by using two FETs.

In order to make current rise, an ON signal is applied to FETs 60*b* and 60*c*. Current starts flowing from a power source 61*b* and through a circuit A-E-B-C-D-F. Next, when the drive signal for FET 60*b* is turned OFF while the ON signal is applied to FET 60*c*, the current circulates and attenuates in a circuit B-C-D-E. When both the drive signals 1 and 2 are turned OFF, the circulated current extinguishes at once.

FIGS. 9A to 9G are timing charts that illustrate drive signals and valve operations of the drive circuit shown in FIG. 8. Different from the drive circuits shown in FIGS. 2 and 6, the electromagnetic valve drive signal include two systems: "drive signal 1" as a command value for FET 60*b* and a "drive signal 2" as a command value for FET 60*c*. These drive signals are applied to FET 60*b* and FET 60*c* in accordance with calculations by the pump controller 59 or upper level controller 63. The "C point potential" shown in FIG. 9D indicates a potential at point C in the drive circuit shown in FIG. 8. When the drive signal 1 is OFF, the potential is the same as a power source voltage (VB), and when the drive signal 1 is ON, the potential is the same as a ground potential (GND).

Figures 9A, 9B, 9C, 9D, 9E, 9F, 9G:
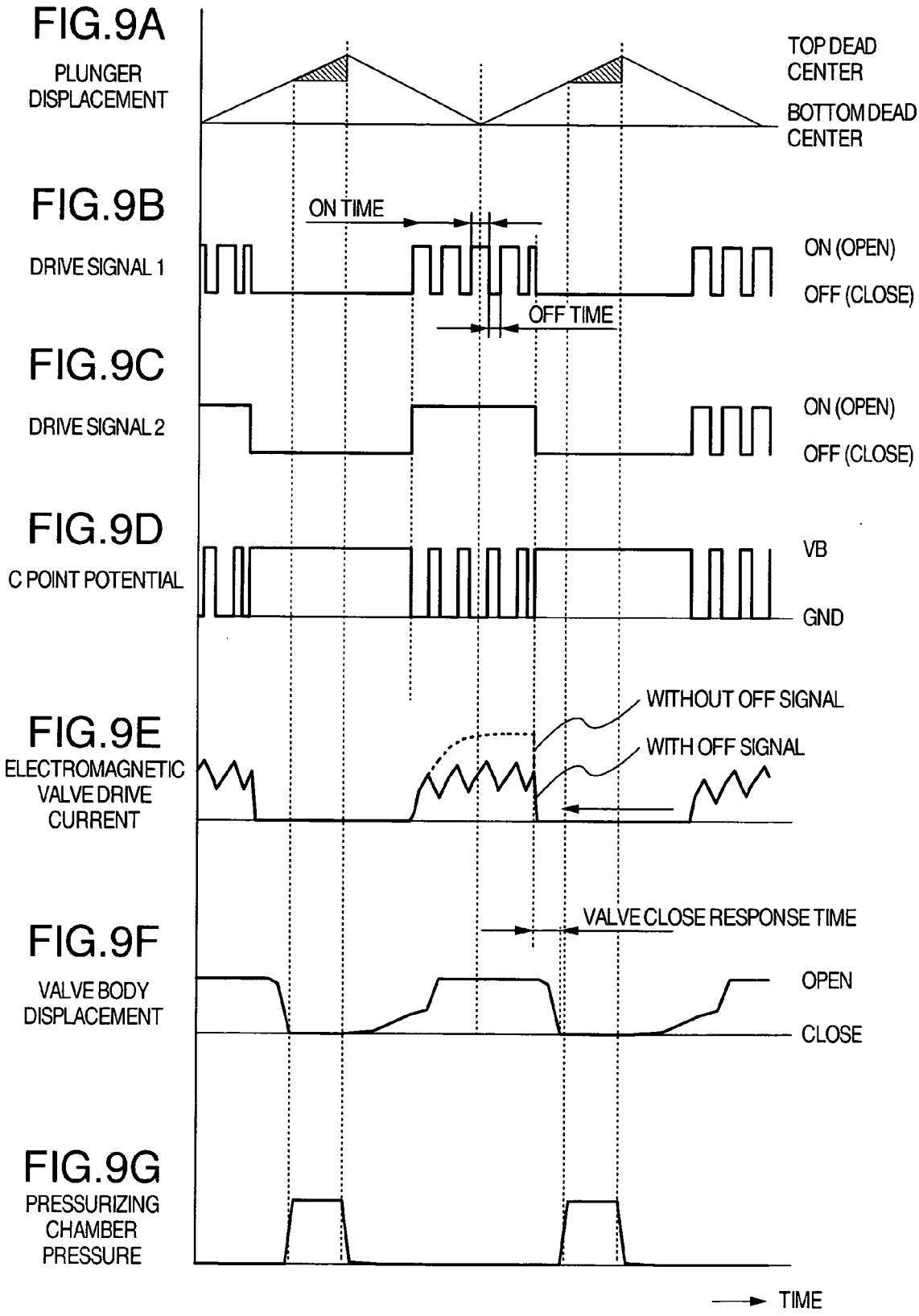
FIGS. 9A to 9G are timing charts illustrating the operation of the pump and pump controller shown in FIG. 8 in the high pressure fuel supply system of the embodiment.

An "electromagnetic valve drive current" shown in FIG. 9E indicates current flowing through the electromagnetic valve 8. As the drive signal 1 is turned ON while the drive signal 2 is turned ON, current increases, and as the drive signal 1 is turned OFF while the drive signal 2 is turned ON, current attenuates. Similar to the free wheel circuit shown in FIG. 6, the electromagnetic valve drive current repetitively increases and decreases while the drive signal 2 is tuned ON. When the drive signals 1 and 2 are turned OFF, the current waveform is extinguished at once similar to the circuit shown in FIG. 2.

In this circuit structure, the drive signals 1 ON and OFF are periodically applied during the open period of the valve body 5 from the suction process to the discharge process. Therefore, similar to the circuit structure shown in FIGS. 7A to 7F, the drive current repeats alternately an increase and an attenuation as indicated by a solid line in FIG. 9E, to perform pseudo current control. As compared with no OFF signal indicated by a dotted line, an average current reduces to a greater extent so that the caloric power dissipation of the electromagnetic valve 8 and the whole system consumption power can be reduced. Further, a surge voltage is not loaded on FET 60*b* and FET 60*c* so that this circuit structure has the advantage of good durability. Moreover, similar to the circuit shown in FIG. 2, extinguishment of the last current can be made abruptly, so that it is possible to obtain a short valve close response time like that of the circuit shown in FIG. 2.

Control of the high pressure fuel supply system of the embodiment may be based on parameters such as an engine speed and an engine load. It becomes more effective if the embodiment of the control method (by applying a valve open signal having a time duration shorter than the valve close signal response time of the electromagnetic valve during the electromagnetic valve open period) is executed at a particular engine speed or engine load. For example, if an engine speed is low, the time duration of the valve close signal can be prolonged because the valve close response time is long, and the caloric power can be reduced further effectively. Conversely, if the engine speed is high, it becomes necessary to shorten the time interval of valve close signals, so that any significant reduction in the caloric power cannot be expected, even if the embodiment control method is adopted. It is therefore effective to adopt the embodiment control method only at a particular engine speed.

A simple control method may be adopted by which an engine speed or engine load is detected, and if the detected value exceeds a threshold value, a time duration of the valve close signal during the valve open period is set to zero. (Another control method providing the effects of calorific power reduction may be performed depending upon a value of the engine speed or engine load, or if such effects cannot be expected, the valve close signal may be set to zero).

Although there is a conventional drive current reduction method using current control, a current control circuit having a feedback function through detection of a current value is generally expensive. The embodiment of the present invention can be realized by using a circuit which does not have a current detector circuit and a feedback circuit, such as the circuit structures shown in FIGS. 2, 6 and 8. System cost can therefore be reduced.

As described so far, the high pressure fuel supply system according to an embodiment of the present invention has the following configuration to realize the functions and operations thereof. Namely, the pressure fuel supply system includes: a high pressure fuel pump including a pressurizing chamber for fuel, a pressurizing member for sending fuel in the pressurizing chamber toward a discharge passage in a pressurizing manner, and a normally closed electromagnetic valve disposed in a suction passage, wherein fuel in the pressurizing chamber is compressed by an open/close operation of the electromagnetic valve and a reciprocal operation of the pressurizing member; and a controller for calculating a valve open signal and a valve close signal for the electromagnetic valve in accordance with a state amount of an engine, and supplying a drive current to the electromagnetic valve, wherein the controller applies and the valve close signal having a time duration shorter than a valve close response time during a valve open period of the electromagnetic valve, the valve close response time being a time taken to close the electromagnetic valve after the valve close signal is applied. Caloric power dissipation of the electromagnetic valve can therefore be reduced by avoiding continuous power supply to the electromagnetic valve, while the open state of the electromagnetic valve is maintained.

Since the valve open signal is turned off before the drive current reaches saturation peak value of the drive current can be reduced. It is therefore possible to reduce the caloric power dissipation of the electromagnetic valve, power consumption of the whole system, and the load on the drive circuit. Since the control method of the invention does not require a current feedback function, drive means can be realized with low cost. The controller applies the valve open signal and valve close signal alternately and periodically during the open state of the electromagnetic valve to maintain an open state of the electromagnetic valve. It is therefore possible efficiently to provide a longer power supply stop period, and to realize further reduction in the caloric power.

The ratio between the valve open time duration and valve close time duration is changed with the flow rate of fuel flowing in the pump. The response time of the electromagnetic valve is influenced by the flow rate of fuel flowing in the pump. Namely, if a flow rate is fast, a large fluid force is applied to the electromagnetic valve so that valve close operation is fast. On the other hand, if the flow rate is slow, valve close operation is slow. Therefore, if the flow rate is slow, the valve open state can be maintained even if the valve close signal is applied for a long time. If the flow rate is slow, (i.e., if the flow rate of discharged fuel is slow), the ratio of the valve open signal is lowered, so that the caloric power can be reduced further.

The controller has means for detecting an operation speed of the pressurizing member, a drive voltage of the electromagnetic valve, and a discharge flow amount and means for changing the ratio between the valve open signal and valve close signal in accordance with the operation signal, drive voltage and discharge flow amount. The power supply stop period can be maximized in accordance with the operation speed, drive voltage and discharge flow amount, so that caloric power dissipation can be reduced further.

The slower the operation speed of the pressurizing members, the smaller the ratio of the valve open signal to the valve close signal is set. Since the fluid force applied to the electromagnetic valve is weak if the operation speed of the pressurizing member is slow, the valve open state can be maintained even if the ratio of the valve open signal time duration is made small. By applying the shortest valve open signal in accordance with the operation state of the internal combustion engine, the caloric power can be reduced further.

The higher the drive voltage of the electromagnetic valve, the smaller the ratio of the valve open signal time duration to the valve close signal time duration is set. Since a large current flows through the electromagnetic valve if the drive voltage is high, a sufficient valve holding power can be obtained even with a shorter power supply time. If the drive voltage is high, the power supply time is shortened, so that the caloric power dissipation during high voltage drive can be reduced.

As described above, the controller of the high pressure fuel supply system according to the invention can reduce the caloric power dissipation of the electromagnetic valve, and reduce power consumption of the whole system, by applying the valve close signal during periods of valve open operation.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A control device for controlling a high pressure fuel supply system comprising a high pressure fuel pump including a pressurizing chamber that communicates with a fuel suction passage and a fuel discharge passage a pressurizing member for sending pressurized fuel in said pressurizing chamber toward said discharge passage a discharge valve disposed in said discharge passage, and a normally closed electromagnetic valve disposed in said suction passage, fuel in said pressurizing chamber being compressed by an open/close operation of said electromagnetic valve and a reciprocal operation of said pressurizing member; said control device comprising:

a controller for calculating a valve open signal and a valve close signal for said electromagnetic valve in accordance with an operating state of an engine, and for supplying a corresponding drive current to said electromagnetic valve for opening said normally closed electromagnetic valve during a valve open period; wherein, a discharge flow amount of said electro magnetic valve is determined by a duration of said valve open period;

during said valve open period of said electromagnetic valve, said controller periodically applies a valve close signal for interrupting said drive current for a time duration that is shorter than a valve closing response time of said electromagnetic valve; and said valve close response time is a time required to close said electromagnetic valve when said valve close signal is applied, whereby said interruption of said drive current during said valve open period does not affect the discharge flow amount of said electromagnetic valve.

2. The control device for controlling a high pressure fuel supply system according to claim 1, wherein said valve close signal which is applied during said valve open period has a time duration that does not completely close said electromagnetic valve.

3. The control device for controlling a high pressure fuel supply system according to claim 1, wherein said controller applies said valve close signal and said valve open signal alternately and periodically during the valve open period of said electromagnetic valve.

4. The control device for controlling a high pressure fuel supply system according to claim 1 wherein said controller detects an engine speed of said engine and changes a ratio between a valve open signal time duration and a valve close signal time duration during the valve open period of said electromagnetic valve in accordance with said detected engine speed.

5. The control device for controlling a high pressure fuel supply system according to claim 4, wherein a ratio of said valve open time duration to said valve close time duration becomes smaller as said engine speed decreases.

6. The control device for controlling a high pressure fuel supply system according to claim 1, wherein said controller detects one of a drive voltage of said electromagnetic valve, an operation speed of said pressurizing member and a discharge flow amount of said high pressure fuel pump, and changes a ratio between a valve open signal time duration and a valve close signal time duration during the valve open period of said electromagnetic valve, in accordance with said detected drive voltage, operation speed or discharge flow amount.

7. The control device for controlling a high pressure fuel supply system according to claim 6, wherein a ratio of said valve open time duration to said valve close time duration decreases as a power supply voltage of said electromagnetic valve increases.

8. The control device for controlling a high pressure fuel supply system according to claim 3, wherein;

said controller detects a value of one of an engine speed and an engine load; and if a detected value exceeds a threshold value, the time duration of said valve close signal during said valve open period is set to zero.

9. A control device for an electromagnetic valve for a high-pressure fuel supply pump, said control device comprising:

a controller which controls supply of power to the electromagnetic valve; wherein, the electromagnetic valve controls an opening/closing operation of a fuel guide port of the high-pressure fuel supply pump in accordance with a drive signal from the controller to thereby control a discharge flow amount of the high-pressure fuel supply pump;

while supplying the drive signal to the electromagnetic valve, the controller supplies a non-driving-duration signal for de-energizing the electromagnetic valve and saving electric power to the electromagnetic valve; and the non-driving-duration signal has a duration such that it does not affect the opening/closing operation of the electromagnetic valve and hence does not affect the discharge flow amount of the high-pressure fuel supply pump.

10. The control device according to claim 9, wherein the electromagnetic valve starts to close at an end portion of the drive signal.

11. A method of controlling an on-off electromagnetic valve constituting a variable displacement control valve of a high-pressure fuel supply pump, said electromagnetic valve having an on operating state in which it is driven to an open position, and an off operating state, in which it is in a closed position; said method comprising the step of:

during a driving period of the on-off electromagnetic valve, providing an off-instruction signal period which forms a non-driving-duration signal that does not affect opening/closing operation of the on-off electromagnetic valve and also does not affect a discharge flow amount of the high-pressure fuel supply pump.

12. The method according to claim 1, wherein the on-off electromagnetic valve starts to close at an end portion of the driving period of the on-off electromagnetic valve.

* * * * *